US005507102A

United States Patent [19]

De Vroome et al.

[11] Patent Number: 5,507,102

[45] Date of Patent: Apr. 16, 1996

[54] DRIER HAVING A DRYING CHAMBER WITH TWO SEPARATE GAS INLETS

[75] Inventors: Clemens J. M. De Vroome, Beugen; Martinus J. C. Van Liempt, Arnhem, both of Netherlands

[73] Assignee: Stork Contiweb B.V., Boxmeer, Netherlands

[21] Appl. No.: 263,396

[22] Filed: Jun. 21, 1994

Related U.S. Application Data

[63] Continuation of Ser. No. 975,357, Nov. 16, 1992, abandoned.

[30] Foreign Application Priority Data

Nov. 19, 1991 [NL] Netherlands ..... 91011926

[51] Int. Cl.[6] ..... F26B 19/00

[52] U.S. Cl. ..... 34/62; 34/636; 34/640; 34/433; 34/643; 34/461

[58] Field of Search ..... 34/629, 636, 619, 34/451, 513, 35, 86, 79, 391, 433, 444, 460, 461, 464, 487, 630, 640, 643

[56] References Cited

U.S. PATENT DOCUMENTS

| | | | |
|---|---|---|---|
| 4,168,579 | 9/1979 | Ericsson | 34/155 |
| 4,270,283 | 6/1981 | Ellis | 34/75 |
| 4,475,294 | 10/1984 | Henricks | 34/79 |
| 4,490,924 | 1/1985 | Lambert | 34/31 |
| 4,575,952 | 3/1986 | Bodenan et al. | 34/156 |
| 4,622,761 | 11/1986 | Barth | 34/79 |
| 4,888,884 | 12/1989 | Bartling et al. | 34/79 |

FOREIGN PATENT DOCUMENTS

| | | |
|---|---|---|
| 0127697 | 12/1984 | European Pat. Off. . |
| 0264637 | 4/1988 | European Pat. Off. . |
| 0284710 | 10/1988 | European Pat. Off. . |
| 0326227 | 8/1989 | European Pat. Off. . |
| 0428236 | 5/1991 | European Pat. Off. . |
| 8401021 | 3/1984 | WIPO . |

*Primary Examiner*—Denise L. Gromada
*Attorney, Agent, or Firm*—Evenson, McKeown, Edward & Lenahan

[57] ABSTRACT

A device for drying strips of printed material includes a drying chamber through which the strips of printed material are carried, the drying chamber being divided into at least two sections by walls and being as gas-tight as possible in relation to the environment, at least one burner connected to the drying chamber by an outlet duct for discharging at least a portion of combustion gases and connected to the drying chamber by a feed duct for feeding to the burner gases saturated with solvents and structure for feeding fresh air to a first of the at least two sections being located at a first outer end of the drying chamber. The feed duct is connected to a second of the at least two sections.

21 Claims, 2 Drawing Sheets

DRIER HAVING A DRYING CHAMBER WITH TWO SEPARATE GAS INLETS

Figure 1:
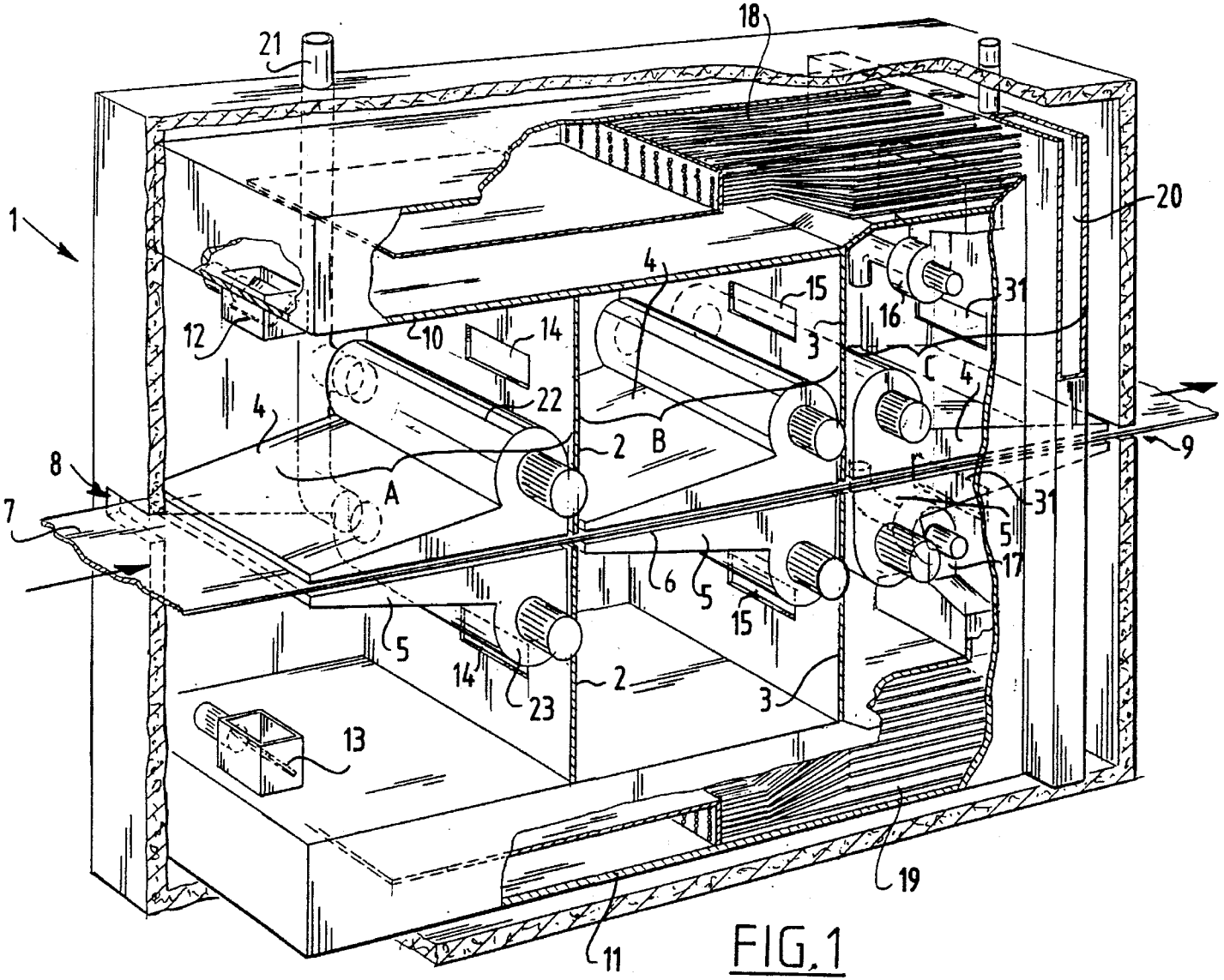

This application is a continuation of U.S. application Ser. No. 07/975,357 filed Nov. 16, 1992, now abandoned.

The present invention relates to a device for drying trips of printed material, comprising:

a drying chamber through which the strips of material for drying are carried, which drying chamber is divided into at least two sections by walls extending substantially perpendicularly of the direction of movement of the strips of printed material; and at least one burner which is connected to the drying chamber by an outlet duct for discharging at least a portion of the combustion gases and which is connected to the drying chamber by a feed duct for feeding to the burner gases saturated with solvents, wherein the drying chamber is as gas-tight as possible in relation to the environment.

Such a drier is known from a brochure of Stork Contiweb B.V. distributed in the first six months of 1990.

In this known drier the fresh air, which in the present case comes from a cooling section connected downstream of the drier, is fed to a first and second section as seen in the direction of movement. Hot combustion gases coming from the burner are moreover fed to the first section. The temperature in the first section can thus be well controlled by regulating the feed of combustion gases and the supply of fresh air.

In the case of the second section control is less good because fresh air is also added to the second section so that the temperature in the second section cannot be controlled well. The temperature in the second section depends namely on the quantity of gas supplied from the first section, and thereby on the pressure difference between the first and second section, and also on the supplied quantity of fresh air.

The present invention obviates this drawback in that means are provided for feeding fresh air to only one of the sections located at the outer ends of the drying chamber.

As a result of this step the temperature prevailing in the second section is dependent only on the pressure difference between the first and the second section. A better control and a better reproducibility of the temperature prevailing in the diverse sections is thus obtained.

According to a preferred embodiment the outlet duct for the combustion gases debouches in the same section as the means for supplying fresh air.

This step also results in a better control of the temperatures prevailing in the sections.

According to another preferred embodiment the means for supplying fresh air are adapted for feeding fresh air to the section located furthest downstream. This means that a gas flow will be created from the section located downstream to the section located furthest upstream, that is, counter to the direction of movement of the strips of material for drying. The advantages of the counterflow principle are thus obtained. This is the case for both the oil concentration and the prevailing temperatures.

Figure 2:
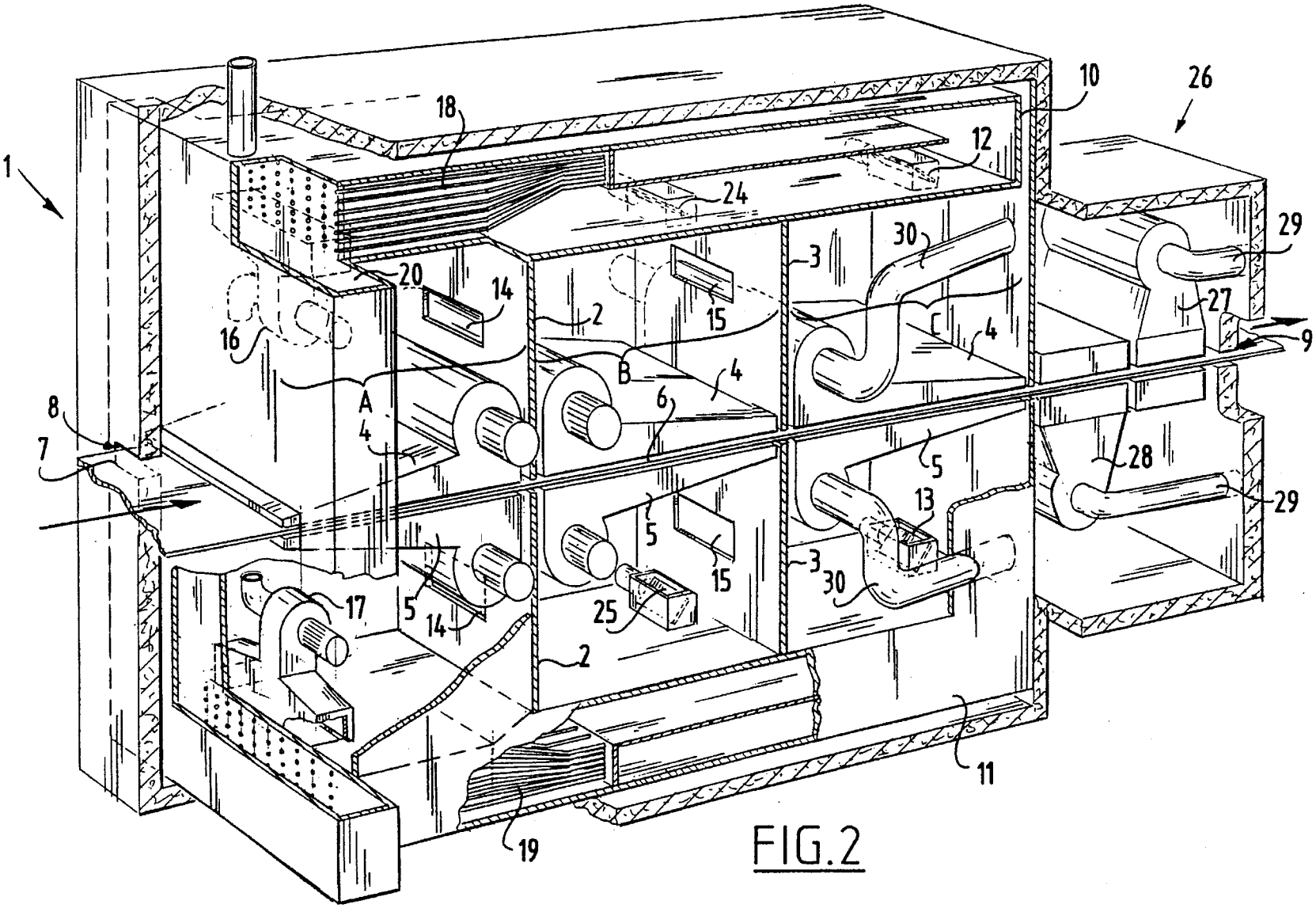

The present invention will subsequently be elucidated with reference to the annexed embodiments, wherein:

FIG. 1 shows a schematic sectional view of a first embodiment of a drier according to the present invention; and FIG. 2 shows a schematic view of a second embodiment of a drier according to the present invention.

The drier depicted in FIG. 1 comprises a drier housing 1 which is divided into three sections A, B and C by walls 2, 3. Arranged in each of the sections A, B and C are two nozzle units 4, 5. A duct 6 for transporting the strip 7 for drying is recessed between each pair of nozzle units 4, 5. The drier has a substantially mirror-symmetrical configuration in relation to the duct 6. The strip of material for drying is carried into the housing 1 through an intake opening 8 arranged in housing 1 and carried out again through an outlet opening 9. The strip of material is moved forward by mechanisms not forming part of the drying device and thus not described.

Such a drier is described in the Netherlands patent application number 89.02825 in the name of applicant. Reference is made to this literature for a more comprehensive description of a drier.

Two burners 10, 11 are further arranged in the drier. Each of the burners is provided with an outlet opening 12 respectively 13 through which the combustion gases coming from the burner 10 respectively 11 are fed to the section A.

Inside the section A internal circulation through both nozzle units 4, 5 takes place. A portion of the gas mixture present in the section A is fed via openings 14 arranged in the dividing wall 2 to the section B where circulation again takes place inside the nozzle units 4, 5 present therein.

The gas mixture is subsequently fed through openings 15 arranged in the dividing wall 3 to the final section C. Recirculation is here also carried out again. The gas mixture present in section C is then fed by means of fans 16, 17 arranged therein to the respective burners 10, 11.

In the burner a portion of the gas mixture formed from oils and solvents evaporated out of the material for drying is burned together with externally supplied fuel, for instance methane or natural gas.

The combustion gases resulting herefrom are fed back partly to the first section A via the adjustable valves 12, 13 and partly to a preheating device 18, 19 which forms part of the burner 10, 11 and where gas mixture supplied via the respective fans 16, 17 is preheated. The remaining portion of the combustion gases is then discharged to the outside via a common discharge duct 20. It is possible, however, to arrange valves 31 in the common discharge duct 20 so that a portion of the gases discharged via duct 20 is fed to the section C.

Gas will thus be discharged from the system as thusfar described so that gas must be supplied from outside, this in the form of air. This takes place by means of a feed duct 21 which debouches into the first section A. To ensure the most effective possible use of this fresh air, it is fed into the vicinity of the suction openings of the fans 22, 23 associated with the respective nozzle units 4, 5. The fresh air is there taken up into the gas circuit prevailing inside the first section A.

It will be apparent that as a result of the fact that the combustion gases coming from the burners 10, 11 are fed to the first section A the temperature in the first section A will be higher than that in the other sections B and C. The fact that fresh (and thus cold) air is also fed to the first section A does not alter this fact. Because the pressure distribution inside the sections is known or can be calculated, the openings 14, 15 arranged in the walls 2, 3 can be dimensioned such that the flow of the gases from section A to the section B and therefrom to section C can be accurately determined. The temperature distribution inside the sections is thereby fixed so that a good control is obtained.

In the embodiment shown in FIG. 2 components corresponding with the embodiment shown in FIG. 1 are designated with the same reference numerals. A description of these components is omitted.

In the embodiment depicted in FIG. 2 transport of the gas mixture takes place counter to the direction of movement of the strip of material 7 for drying. To this end a portion of the gases originating from the burners 10, 11 is fed by means of the controllable valves 12, 13 to the third section C. Another portion of the gases originating from the burners 10, 11 is carried via controllable valves 24, 25 to the second section B. The fresh air is also fed to the section C.

The thus created gas mixture is subsequently fed through the openings 15 to the second section B where mixing takes place with the gases fed via the valves 24, 25. The mixture is thereafter fed through the openings 14 to the first section A. The gas mixture is there returned to the burners 10, 11 by means of the fans 16, 17. The remaining portion of the combustion gases originating from the burners 10, 11 is here also discharged by means of the heat exchangers 18, 19 and the outlet pipe 20. The heat exchangers 18, 19 also provide for transfer of the heat to the gases for burning.

It will be apparent that in this embodiment the flow direction of the heating and drying gases is opposed to the direction of movement of the strip of material for drying. The temperature of the gas mixture will thus decrease counter to the direction of movement so that drying initially takes place at a comparatively low temperature and subsequently at a comparatively high temperature. The reverse is true with respect to the concentration of the evaporated solvents and oils; as a consequence of the counterflow principle the concentration of the solvents and oils will decrease in the direction of movement.

The saturation of the vapour of the oils and solvents in the drying gases will therefore also decrease in the direction of movement as a result of the decreasing concentration and increasing temperature.

The same is true for the concentration of the solvents evaporated from strips of material for drying.

Additional combustion gases are fed to the middle section B by means of the valves 24, 25. This is a step related to the dimensioning of the device. This step can therefore also be omitted.

This second preferred embodiment further differs from the first embodiment in the fact that subsequent to the third section C a cooling section 26 is arranged. The cooling section 26 is likewise provided with two nozzle units 27, 28, wherein however air originating from outside is fed to both nozzle units by means of the feed ducts 29.

It is however also possible to sub-divide the cooling section 26 into separate compartments. In such a situation a vertical wall is arranged between both nozzle units 27, 28 and, as in the embodiment shown in FIG. 2, the outside air is supplied to the first nozzle unit 27 via the relevant duct 29. The other feed duct 29 is then shortened so that the second nozzle unit 28 draws its air from the first compartment.

After passing through the nozzle units 27, 28 the air enters the cooling section 26 and is fed therefrom by means of feed pipes 30 to the feed openings of the nozzle units 4, 5 arranged in the final section C. The operation of this device otherwise corresponds with that of the first mentioned embodiment.

We claim:

1. A device for drying strips of printed material, comprising:

a drying chamber through which the strips of printed material are carried, said drying chamber being divided into at least two sections and being as gas-tight as possible in relation to the environment, at least one burner connected to said drying chamber by an outlet duct for discharging at least a portion of combustion gases and by a feed duct for feeding to the at least one burner gases saturated with solvents, and means for feeding fresh air to a first of the at least two sections located at a first outer end of said drying chamber wherein the feed duct is connected to a second of the at least two sections.

2. Device as claimed in claim 1 wherein the outlet duct for discharging at least a portion of the combustion gases debounches in the first of the at least two sections.

3. Device as claimed in claim 1 wherein the first of the at least two sections is located furthest downsteam.

4. Device as claimed in claim 1 wherein downstream of said drying chamber is arranged a cooling chamber through which the strips of printed material are carried and the fresh air is drawn from the cooling chamber.

5. Device as claimed in claim 4 wherein the cooling chamber is divided into two sections.

6. Device as claimed in claim 1 wherein the means for feeding fresh air is adapted for feeding fresh air to the direct vicinity of a suction mouth of a fan accommodated in the first of the at least two sections.

7. Device as claimed in claim 1 wherein the means for feeding fresh air is formed by a pipe in which a valve is arranged.

8. Device as claimed in claim 2 wherein the first of the at least two sections is located furthest downstream.

9. Device as claimed in claim 2 wherein downstream of said drying chamber is arranged a cooling chamber through which the strips of printed material are carried and the fresh air is drawn from the cooling chamber.

10. Device as claimed in claim 3 wherein downstream of said drying chamber is arranged a cooling chamber through which the strips of printed material are carried and the fresh air is drawn from the cooling chamber.

11. Device as claimed in claim 2 wherein the means for feeding fresh air is adapted for feeding fresh air to the direct vicinity of a suction mouth of a fan accommodated in the first of the at least two sections.

12. Device as claimed in claim 3 wherein the means for feeding fresh air is adapted for feeding fresh air to the direct vicinity of a suction mouth of a fan accommodated in the first of the at least two sections.

13. Device as claimed in claim 4 wherein the means for feeding fresh air is adapted for feeding fresh air to the direct vicinity of a suction mouth of a fan accommodated in the first of the at least two sections.

14. Device as claimed in claim 5 wherein the means for feeding fresh air is adapted for feeding fresh air to the direct vicinity of a suction mouth of a fan accommodated in the first of the at least two sections.

15. Device as claimed in claim 2 wherein the means for feeding fresh air is formed by a pipe in which a valve is arranged.

16. Device as claimed in claim 3 wherein the means for feeding fresh air is formed by a pipe in which a valve is arranged.

17. Device as claimed in claim 4 wherein the means for feeding fresh air is formed by a pipe in which a valve is arranged.

18. Device as claimed in claim 5 wherein the means for feeding fresh air is formed by a pipe in which a valve is arranged.

19. Device as claimed in claim 6 wherein the means for feeding fresh air is formed by a pipe in which a valve is arranged.

20. The device as claimed in claim 1 further comprising means for separating the drying chamber into said section.

21. The device as claimed in claim 20 wherein said means for separating are walls.

* * * * *